US007067024B2

(12) United States Patent
Doll et al.

(10) Patent No.: US 7,067,024 B2
(45) Date of Patent: Jun. 27, 2006

(54) REDUCED SENSITIVITY, MELT-POURABLE TNT REPLACEMENTS

(75) Inventors: Daniel W. Doll, Ogden, UT (US); Jami M. Hanks, Logan, UT (US); Alan G. Allred, Brigham City, UT (US); John B. Niles, Lake Hopatacong, NJ (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/893,337

(22) Filed: Jun. 27, 2001

(65) Prior Publication Data

US 2003/0005988 A1 Jan. 9, 2003

(51) Int. Cl.
*C06B 45/06* (2006.01)
*C06B 25/04* (2006.01)

(52) U.S. Cl. ..... 149/18; 149/105

(58) Field of Classification Search ..... 149/18, 149/109

See application file for complete search history.

(56) References Cited

U.S. PATENT DOCUMENTS

| | | | | | |
|---|---|---|---|---|---|
| 3,178,325 | A | | 4/1965 | Scott | |
| 3,379,585 | A | | 4/1968 | Miller et al. | |
| 3,574,298 | A | * | 4/1971 | Larson | 181/113 |
| 3,620,857 | A | * | 11/1971 | Soderberg et al. | 149/107 |
| 3,957,550 | A | | 5/1976 | Tannenbaum et al. | |
| 3,994,756 | A | | 11/1976 | Hendrickson, Sr. et al. | |
| 4,201,853 | A | * | 5/1980 | Henry et al. | 149/105 |
| 4,360,394 | A | * | 11/1982 | Portnoy | 149/105 |
| 4,600,452 | A | * | 7/1986 | Jessop et al. | 149/18 |
| 4,705,582 | A | * | 11/1987 | Aubert | 149/105 |
| 4,747,892 | A | | 5/1988 | Spencer | |
| 4,889,571 | A | | 12/1989 | Willer et al. | |
| 4,944,816 | A | | 7/1990 | Sayles | |
| 5,067,996 | A | | 11/1991 | Lundstrom et al. | |
| 5,302,763 | A | * | 4/1994 | Quakenbush | 568/934 |
| 5,358,587 | A | * | 10/1994 | Voigt, Jr. | 149/18 |
| 5,398,612 | A | | 3/1995 | Graham et al. | |
| 5,411,615 | A | * | 5/1995 | Sumrail et al. | 149/47 |
| 5,431,756 | A | * | 7/1995 | Kosowski et al. | 149/18 |
| 5,468,313 | A | | 11/1995 | Wallace, II et al. | |
| 5,500,060 | A | | 3/1996 | Holt et al. | |
| 5,529,649 | A | * | 6/1996 | Lund et al. | 149/105 |
| 5,552,000 | A | * | 9/1996 | Shepherd, Jr. | 149/105 |
| 5,587,553 | A | | 12/1996 | Braithwaite et al. | |
| 5,675,119 | A | | 10/1997 | Otani et al. | |
| 5,717,158 | A | * | 2/1998 | Capellos et al. | 149/18 |
| 5,728,969 | A | | 3/1998 | Otani et al. | |
| 5,949,016 | A | | 9/1999 | Baroody et al. | |
| 5,997,668 | A | | 12/1999 | Aubert et al. | |
| 6,156,136 | A | * | 12/2000 | Bottaro et al. | 149/19.1 |
| 6,255,512 | B1 | * | 7/2001 | Bottaro et al. | 556/422 |
| 6,425,966 | B1 | * | 7/2002 | Highsmith et al. | 149/19.1 |

FOREIGN PATENT DOCUMENTS

| | | | |
|---|---|---|---|
| DE | 100 522 | A | 6/1897 |
| DE | 1 221 945 | B | 7/1966 |
| DE | 23 35 925 | A1 | 2/1975 |
| DE | 37 44 680 | A1 | 11/1991 |
| FR | 349 635 | | 4/1904 |
| FR | 349 635 | A | 4/1904 |
| FR | 465 082 | | 11/1913 |
| GB | 1 605 421 | | 11/1998 |
| WO | WO 98/49123 | | 11/1998 |
| WO | WO 01/46092 | A1 | 6/2001 |

OTHER PUBLICATIONS

Chemical Abstracts, vol. 129, No. 18, Abstract No. 232724z, R.D. Chapman et al., A convenient correlation for prediction of binary eutectics involving organic explosives, p. 858 (XP000786346) (Nov. 2, 1998).

Joint Technical Bulletin, Navy document No. NAVSEA INST 8020.8B, Air Force technical order 11A 1 47, Defense Logistics Agency regulation DLAR 8220.1, and Army technical bulletin TB700 2, Jan. 5, 1998, 99 pages.

* cited by examiner

*Primary Examiner*—Aileen Felton
(74) *Attorney, Agent, or Firm*—TraskBritt

(57) ABSTRACT

This melt-pourable explosive composition shares explosive properties comparable to those of trinitrotoluene and is melt-pourable and castable under conditions comparable to those of trinitrotoluene, but experiences equal or less impact, shock, and thermal sensitivity and avoids the issues of toxicity associated with trinitrotoluene. Trinitrotoluene is replaced with one or more mononitro aromatic and/or dinitro aromatic melt-pourable binders, such as dinitroanisole, which can be melt poured without presenting the toxicity drawbacks experienced with the use of TNT. The melt-pourable binder can also be combined with a processing aid selected from the group consisting of alkylnitroanilines and arylnitroanilines. The composition also includes oxidizer particles, which are preferably inorganic oxidizer particles.

43 Claims, No Drawings

REDUCED SENSITIVITY, MELT-POURABLE TNT REPLACEMENTS

GOVERNMENT LICENSING CLAUSE

The U.S. Government has a paid-up license in this invention and the right in limited circumstances to require the patent owner to license others on reasonable terms as provided by the terms of DAAE30-98-D-1005 awarded by Picatinny Arsenal of the U.S. Army.

BACKGROUND OF THE INVENTION

1. Field of the Invention

This invention relates to explosives and, in particular, this invention relates to explosives that are melt-pourable and may function as excellent replacements for trinitrotoluene (TNT). In a particularly preferred aspect, this invention relates to TNT replacement compositions that exhibit similar melting characteristics, comparable energetic performance, and either comparable or reduced shock and thermal sensitivities to TNT. This invention also relates to mortars, grenades, artillery, warheads, and antipersonnel mines containing the melt-pourable TNT replacement compositions.

2. State of the Art

The melt-pourable explosive 2,4,6-trinitrotoluene (TNT) has been used in a wide array of military applications. For example, TNT has found use in artillery, bombs, land mines, mortars, grenades, and the like. One of the reasons for the wide acceptance of TNT is its relative low melting point of 81° C., which makes TNT suitable for pouring into shells or casings of munitions. In fact, TNT has received wide acceptance and use in the industry to the extent of becoming a well-known explosive in the art and in the public at large.

However, TNT has several drawbacks. One of the most prominent of these drawbacks of TNT is its toxicity. During synthesis of TNT, undesirable isomers are produced. Without wishing to be bound by any theory, it is believed that meta isomers produced during the nitration of toluene react with the sodium sulfite to produce water-soluble, sulfated nitrotoluene that is red and highly toxic. Waste streams containing these isomers are known as red and pink water, and are considerably toxic and hazardous to workers and the environment. Consequently, stringent domestic environmental regulations have been imposed to protect worker safety and prevent against adverse ecological impact caused by the waste streams. However, waste stream cleanup is laborious and expensive. These regulations and safety precautions have also increased manufacturing costs and slowed production rates, thereby making TNT production largely uneconomical and leading to cessation of domestic TNT production by most, if not all domestic manufacturers.

The generation of undesirable isomers during TNT synthesis has the additional drawback of increasing the exudation of TNT from the ordnance. Many isomers generated during TNT synthesis have melting points lower than that of TNT. These isomers tend to exude under high storage temperature requirements, such as about 74° C. (165° F.). The exudation of TNT isomers raises concerns that the isomers might enter into areas of munitions that are not designed for exposure to energetic materials. In such an event, the sensitivity, vulnerability, and ability to handle and transport the munitions safely may be compromised.

BRIEF SUMMARY OF THE INVENTION

The present invention provides a TNT replacement that exhibits comparable energetic and pouring properties to TNT. In particular, the TNT replacement exhibits similar energies of detonation and melting points for melt-pouring procedures of TNT. However, the TNT replacement may be produced without as severe toxicity issues as encountered in TNT production and substantially without undesirable isomers that substantially lower the melting point of TNT and cause exudation.

The present invention also provides a TNT replacement that exhibits comparable energetic and pouring properties to TNT, but increases process safety by exhibiting substantially reduced shock sensitivity and/or thermal sensitivity compared to TNT. For example, reduced sensitivity of the TNT replacement may mean a lower vulnerability to physical and thermal stimuli such as, for example, bullet and fragment impact, fast and slow cook-off, and/or sympathetic denotation.

In accordance with the present invention as embodied and broadly described in this document, according to a first aspect of this invention there is provided a melt-pourable explosive composition comprising 30 weight percent to 70 weight percent of one or more organic binders selected from the group consisting of mononitro aromatics and dinitro aromatics and 70 weight percent to 30 weight percent of one or more oxidizers. The aromatic binder or collection of aromatic binders exhibit an energy of detonation that is lower than TNT and collectively have a total melting point in a range of 80° C. to 115° C. The melt-pourable explosive composition is formulated to become melt-pourable at a temperature in a range of 80° C. to 115° C.

In accordance with a second aspect of this invention, a melt-pourable explosive composition comprises 30 weight percent to 70 weight percent of one or more organic binders selected from the group consisting of mononitro aromatics and dinitro aromatics and 70 weight percent to 30 weight percent of one or more inorganic oxidizers. The organic binder or collection of organic binders exhibit a total energy of detonation lower than TNT and collectively have a total melting point in a range of 80° C. to 115° C. The inorganic oxidizer(s) preferably comprise at least one member selected from the group consisting of perchlorates and nitrates, and preferably have an average particle size of 3 to 60 microns, more preferably 5 to 20 microns. It is still more preferable that the mononitro/dinitro aromatic compound(s) and the inorganic oxidizer(s) collectively account for at least 95 weight percent, more preferably at least 99 weight percent, of the total weight of the explosive composition. It is also preferred that the composition be essentially free of TNT. As in the case of the first aspect, in this second aspect the melt-pourable explosive composition is formulated to become melt-pourable at a temperature in a range of 80° C. to 115° C.

In accordance with this invention, a fundamental and well-accepted explosive, 2,4,6-trinitrotoluene, is replaced with one or more aromatic binders, each preferably having one or two nitro groups, more preferably nitrocarbon ($C—NO_2$) moieties, and an oxidizer, preferably an inorganic oxidizer. It has been discovered that mononitro and dinitro aromatics such as dinitroanisole can be melt poured without presenting the same degree of the toxicity drawbacks experienced with the use of TNT. Additionally, many mononitro and dinitro aromatics are lower in cost and more widely available than TNT. Mononitro and dinitro aromatics are less detonable than trinitrated aromatics. Therefore, the mononitro and dinitro aromatics do not require the explosive transportation, storage, and packaging infrastructure that trinitrated compounds, such as TNT, mandate.

Generally, the use of mononitro and dinitro aromatics in place of TNT for melt-pourable explosive compositions has been disfavored (if not overlooked) in the melt-pouring art due to their low energetic oxygen content compared to TNT. This drawback is overcome by the addition of oxidizer particles to the melt-pourable explosive composition. The oxidizer particles are preferably inorganic and preferably have relatively fine particle sizes. The oxidizer particles compensate for the energy loss experienced by the replacement of TNT with the less energetic mononitro and/or dinitro aromatic melt-pourable binders.

Additionally, the different melting points that mononitro and dinitro aromatics possess compared to TNT have also disfavored the melt-pourable binder substitution. Melt pouring requires heating of the binder to a temperature higher than its melting point, so that the binder can be mixed with the energetic filler, which is typically at ambient temperature, and poured by melting. A typical and useful melting point range for the melt or pour process is 80° C. to 115° C. However, melt-pourable explosive compositions should not be heated close to or above their exothermic decomposition temperatures, because exothermic decomposition may cause the explosive composition to ignite automatically and generate an exothermic deflagration or explosion. Preferably, a relatively wide "safety margin" is present between the melt temperature of the explosive composition and the temperature at which the composition experiences an onset of exothermic decomposition. TNT has a melting point of about 80.9° C. and is believed to experience an onset of exothermic decomposition at about 185° C., giving a relatively wide safety margin between the binder melting temperature and the autoignition temperature. On the other hand, many mononitro and dinitro aromatics have melting points exceeding that of TNT, thereby narrowing the safety margin for melt pouring. For example, dinitroanisole has a melting point of 94° C.

This drawback can be overcome by adding a processing aid to the melt-pourable composition. The processing aid is preferably also a mononitro or dinitro aromatic, and more preferably is selected from the group consisting of alkylnitroanilines and arylnitroanilines. The processing aid lowers the overall melting temperature of the energetic composition, preferably into a range of from 80° C. to 115° C., while preferably raising the onset of the exothermic decomposition temperature, preferably to at least 55° C. higher than the melting temperature to widen the safety margin.

This invention is also directed to ordnances and munitions in which the melt-pourable explosive composition of this invention can be used, including, by way of example, mortars, grenades, artillery shells, warheads, and antipersonnel mines.

These and other aspects and advantages of the invention will be apparent to those skilled in the art upon reading the specification and appended claims, which explain the principles of this invention.

DETAILED DESCRIPTION OF PREFERRED EMBODIMENTS AND METHODS OF THE INVENTION

Reference will now be made in detail to the presently preferred embodiments and methods of the invention. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

Generally, the melt-pourable binder or binders constitute 30 weight percent to 70 weight percent, more preferably 40 weight percent to 60 weight percent, of the total weight of the melt-pourable explosive composition. It is preferred that the binder or binders include nitrocarbon (C—$NO_2$) moieties, although the nitro moieties may include nitramines (N—$NO_2$). Exemplary melt-pourable binders suitable for this invention include mononitro-substituted and dinitro-substituted phenyl alkyl ethers having the following formula:

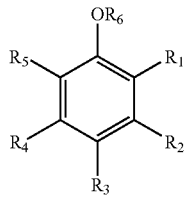

wherein one or two members selected from $R_1$, $R_2$, $R_3$, $R_4$, and $R_5$ are nitro (—$NO_2$) groups, the remaining of $R_1$ to $R_5$ are the same or different and are preferably selected from —H, —OH, —$NH_2$, $NR_7R_8$, an aryl group, or an -alkyl group (such as methyl), $R_6$ is an alkyl group (preferably a methyl, ethyl, or propyl group), $R_7$ is hydrogen or an alkyl or aryl group, and $R_8$ is hydrogen or an alkyl group.

2,4-dinitroanisole (2,4-dinitrophenyl-methyl-ether) and 2,4-dinitrophenetole (2,4-dinitrophenyl-ethyl-ether) are examples of dinitro-substituted phenyl alkyl ethers suitable for use in the present melt-pourable explosive composition, while 4-methoxy-2-nitrophenol is an example of a preferred mononitro-substituted phenyl alkyl ether.

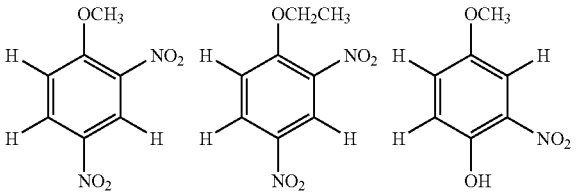

2,4-dinitroanisole (DNAN) 2,4-dinitrophenetole 4-methoxy-2-nitrophenol

DNAN-containing energetic fillers, such as energetic oxidizers, exhibit a lesser tendency to shrink and crack than TNT. The reduced shrinkage and cracking of the DNAN/inorganic oxidizer composition has less liquid melt phase to shrink and crack relative to TNT, which is all liquid melt phase.

As referred to herein, aromatics include phenols and aryl amines. For example, mononitro and dinitro aromatic binders suitable for use with this invention include nitrophenols, such as meta-nitrophenol, para-nitrophenol, and 2-amino-4-nitrophenol; dinitrophenols, such as 2,4-dinitrophenol and 4,6-dinitro-o-cresol; nitrotoluene and dinitrotoluenes, such as 2,4-dinitrotoluene; mononitroanilines, such as ortho-nitroaniline, meta-nitroaniline, para-nitroaniline; and dinitroanilines, such as 2,4-dinitroaniline and 2,6-dinitroaniline. As referred to herein, aromatics also include polycyclic benzenoid aromatics, such as mononitronaphthalenes and dinitronaphthalenes (e.g., 1,5-dinitronapthalene). It is also within the scope of the invention to use one or more heterocyclic binders, such as 4-chloro-7-nitrobenzofurazon, 5-nitro-2-furaldehyde diacetate, 5-nitro-isoquinoline, and methyl-5-nitro-2-furoate.

Other mononitro and dinitro aromatic binders that may be considered include the following:

4-nitrobenzaldehyde;

4-nitroacetophenone;

2-nitrobenzonitrile;

3-nitrobenzophenone;

4-nitrobenzyl alcohol;

4-nitrobenzyl bromide;

4-nitrophenyl acetate;

2-nitrophenyl acetonitrile;

3-nitrophenyldisulfide;

4-nitrophenyl chloroformate;

1-(2-nitrophenyl)-1,2-ethanoldiol;

4-nitrophenyl trimethylacetate;

8-nitroquinoline;

2-nitro-4-(trifluoromethyl)aniline;

4-chloro-3-nitroacetophenone;

methyl-3-hydroxy-4-nitrobenzoate;

methyl-3-nitrobenzoate;

methyl-4-nitrobenzoate;

2-methyl-5-nitrobenzonitrile; and 3-methyl-4-nitrobenzonitrile.

The above examples of representative binders are not meant to be exhaustive. Rather, other aromatic binders may be suitable for this invention. Suitability of the binder is determined by balancing of various features and binder characteristics. For example, the binder preferably can be characterized by several or all of the following attributes: nontoxic, nonhygroscopic, nonmutagenic, light insensitive, air insensitive, noncorrosive, not a lachrymator, moisture insensitive, temperature insensitive between −54° C. and 140° C., melting point between 80° C. and 115° C., and viscosity of lower than 0.64 kp (kilopoise), more preferably lower than 0.16 kp within the pour temperature range of 80° C. to 115° C.

The mononitro and dinitro aromatics generally have a much lower toxicity than TNT, particularly when the aromatics do not contain —OH and/or —$NH_2$ functionalities. Thus, in many instances, the use of mononitro and dinitro aromatics often simplifies handling and reduces the costs associated with manufacturing the melt-pourable explosive.

The processing aid of this invention preferably is a mononitro or dinitro aromatic, and more preferably is one or more N-alkyl-nitroanilines and/or N-aryl-nitroanilines having the following formula:

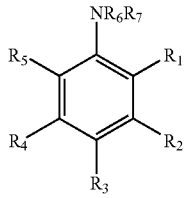

wherein $R_6$ is hydrogen, $R_7$ is an unsubstituted or substituted hydrocarbon (e.g., straight-chain alkyl, branched alkyl, cyclic alkyl, or aryl group), and at least one of $R_1$ to $R_5$ is a nitro group, the remaining of $R_1$ to $R_5$ are the same or different and are preferably selected from —H, —OH, —$NH_2$, $NR_8R_9$, an aryl group, or an -alkyl group (such as methyl), $R_8$ is hydrogen or an alkyl or aryl group, and $R_9$ is hydrogen or an alkyl group. Exemplary N-alkyl-nitroaniline processing aids include the following:

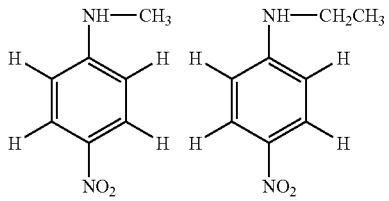

N-methyl-p-nitroaniline (MNA) N-ethyl-p-nitroaniline

Examples of aryl-nitroaniline processing aids include the following:

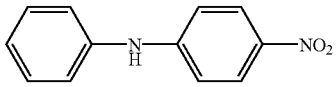

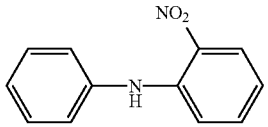

4-nitrodiphenylamine 2-nitrodiphenylamine

The concentration of the processing aid is selected in order to widen the "safety margin" at which the melt-pourable composition can be melt poured without significant threat of an onset of exothermic decomposition and autoignition of the composition. The processing aid preferably acts to lower the melting point of the composition towards (but not necessarily to) its eutectic point. By controlling the amount of the processing aid, the melting point of the mixture of binder and processing aid can be adjusted into a range of 80° C. to 115° C. that generally characterizes melt-pourable materials. More preferably, the melting point is adjusted to 80° C. to 110° C., more preferably 80° C. to 90° C. Simultaneously, the processing aid preferably raises the temperature at which the composition experiences an onset of exothermic decomposition, thereby widening the safety margin between the melting temperature and the autoignition temperature of the melt-pourable composition.

The concentration of the processing aid can be selected by taking into account the amount of melt-pourable binder in the overall melt-pourable explosive composition, the purity of the binder, and the nitrogen content of the binder. Generally, the explosive composition can include, for example, from about 0.15 weight percent to about 1 weight percent of a processing aid based on the total weight of the melt-pourable explosive composition. Using more than about 1 weight percent of the processing aid may lower the pour temperature of the melt-pourable composition to below about 80° C.

Representative inorganic oxidizers suitable for the present melt-pourable explosive composition include perchlorates, such as potassium perchlorate, sodium perchlorate, strontium perchlorate, and ammonium perchlorate; and nitrates, such as potassium nitrate, sodium nitrate, strontium nitrate, ammonium nitrate, copper nitrate ($Cu_2(OH)_3NO_3$), and hydroxylammonium nitrate (HAN); ammonium dinitramide (ADN); and hydrazinium nitroformate (HNF). Organic oxidizers having excess amounts of oxygen available for oxidizing the binder can also be used, although preferably the oxidizers consist of inorganic compounds. Examples of suitable organic oxidizers include nitramines, such as CL-20. In the event an organic oxidizer is used in the melt-pourable explosive composition, the organic oxidizer is preferably present in less than 20 weight percent, more preferably less than 10 weight percent, still more preferably less than 5 weight percent, and most preferably no more than 1 weight percent based on the total weight of the explosive composition.

The oxidizer particles preferably have particle diameters of, on average, 3 to 60 microns, more preferably 5 to 20 microns. It is possible to use bimodal distributions, such as a combination of coarse particles (200 to 400 microns) and fine particles (less than 20). More preferred, however, is a single modal distribution of 5 to 50 microns. In the event that a single modal distribution in this particle size range is selected, the content of inorganic oxidizer in the energetic composition is preferably in a range of 35 weight percent to 60 weight percent.

Preferably, the melt-pourable composition of this invention is substantially free of polymeric binders conventionally found in pressable and extrudable energetic materials, since an undue amount of these polymeric binders can lower the energy (especially for nonenergetic polymer binders) and reduce the melt pourability (by increasing the viscosity) of the melt-pourable explosive.

A process of making the melt-pourable explosive composition will now be described in more detail below. It should be understood that various modifications and alterations to the process and equipment described below are possible and encompassed by this invention.

The binder and optional processing aid are loaded into a pressurized, steam-heated melt kettle having a surrounding jacket. The kettle is heated to a temperature far enough above the melting temperature of the binder and processing aid to prevent solidification of the binder during the subsequent addition of ambient-temperature particles, but not so high as to cause an onset of exothermic decomposition. For example, the kettle may be heated to about 90° C. to 100° C., preferably 95° C. The oxidizer is then added by metering, i.e., adding the oxidizer either in stages or continuously so as not to lower the temperature of the melt phase below its melting temperature. Constant stirring is preferably performed throughout the mix cycle. Stirring is preferably sufficiently rapid to wet the oxidizer particles and achieve homogeneity in a relatively short time. The mixture is then poured or cast, usually into a case of munitions or the like.

As mentioned above, the melt-pourable composition of preferred aspects of this invention exhibits energetic and pouring properties comparable to TNT but increases process safety by exhibiting substantially reduced shock and/or thermal sensitivity compared to TNT.

An indicator of thermal stability is the temperature at which an explosive composition experiences an exotherm, or exothermic decomposition. A test known as Stimulated Bulk Autoignition Test, or SBAT, may be used to determine this temperature. Essentially, the SBAT simulates the thermal response of a large mass of energetic material using only a small quantity of material. The test sample is placed in a Pyrex tube and insulated, and then placed in metal blocks in an oven. An identically insulated nonreactive sample, such as an aluminum block, is placed in the oven alongside of the test sample for temperature comparisons. The samples are heated from 38° C. (100° F.) to 260° C. (500° F.) over a 16-hour period at a rate of 13.3° C./hr (24° F./hr). The temperatures of the energetic material and control are monitored through thermocouples and recorded on a chart until the test is complete. The reaction is recorded along with the onset temperature, which is the temperature at which the data trace of the energetic material first leaves the baseline, i.e., that of the control.

Energetic materials with high autoignition temperatures are desirable because they are less likely to explode or detonate when exposed to elevated temperatures. The energetic composition of this invention preferably experiences an onset of thermal decomposition that is at least 55° C., more preferably at least 100° C., higher than the temperature at which the energetic composition becomes melt-pourable.

One test for measuring shock sensitivity is known in the art as the Large Scale Gap Test (LSGT), in which a test material is placed into a metal tube on top of a witness plate. A predetermined number of PMMA (polymethylmethacrylate) cards are placed between the top of the metal tube and a booster material, which typically consists of 50 wt % PETN (pentaerythritol tetranitrate) and 50 wt % TNT (trinitrotoluene), available as Pentolite. The distance between the booster and the metal tube is expressed in cards, where one card is equal to 0.0254 cm (0.01 inch), such that 100 cards equal 2.54 cm (1 inch). A card gap measurement is the minimum number of cards required to prevent the booster from detonating the explosive sample, so that the sample does not blow a hole through the witness plate. Thus, the lower the card value, the lower the shock sensitivity.

The LSGT (or NOL Card Pipe Test) is more fully described in Joint Technical Bulletin, Navy document number NAVSEA INST 8020.8B, Air Force technical order 11A-1-47, Defense Logistics Agency regulation DLAR 8220.1, and Army technical bulletin TB700-2.

TNT has a measured card gap value of 151. The explosive composition of this invention preferably has a card gap value that is less than 151, more preferably less than 121, and still more preferably less than 101, and most preferably less than 81.

Energetic performance of an explosive can be evaluated through use of calculated properties, such as total energy of detonation, theoretical maximum density (TMD), detonation pressure, shock velocity, cylinder expansion energy, and the like. These properties may be calculated based on the software CHEETAH, available through Lawrence Livermore National Laboratory of Livermore, Calif. This software is well known and used in the art, including by those having ordinary skill in the art of explosive development.

TNT has a total energy of detonation of 7.9 kJ/cc. In an especially preferred embodiment of this invention, the melt-pourable explosive composition has a total energy of detonation within 10 percent of 7.9 kJ/cc, i.e., 7.1 kJ/cc to 8.7 kJ/cc.

A measurable property for determining energetic performance of an explosive is dent depth. Dent depth measurements are conducted by placing a 350 gram sample in a metal tube, identical to the one discussed above and used for the NOL card gap test, having exposed ends. The metal tube sits on a 1018 steel plate having a thickness of 5.08 cm (2 inches) and a width and height of 15.24×15.24 cm (6×6 inches), so that one of the ends of the tube is in contact with the steel plate. A Pentolite booster is placed on top of the metal tube and in operative association with the sample. The explosive is detonated in the pipe by activating the booster. The detonation products from the explosion form an indentation in the steel plate. The depth of this indentation is measured and recorded as the dent depth, which represents the amount of work performed by the explosive.

The dent depth of TNT is about 0.838 cm (0.33 inch). The dent depth of the explosive composition of this invention is preferably within 10 percent of that of TNT, i.e., 0.754 cm to 0.922 cm.

EXAMPLES

The following examples illustrate embodiments that have been made in accordance with the present invention. Also set forth are examples prepared for comparison purposes. The inventive embodiments are not exhaustive or exclusive but merely representative of the invention.

Unless otherwise indicated, all parts are by weight.

Example 1

In a pressurized, steam-heated melt kettle, dinitroanisole (DNAN) and N-methyl-p-nitroaniline (MNA) were introduced and heated above their melting temperatures and stirred until melted and homogeneous. Fifty micron ammonium perchlorate particles were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The flakes were then remelted in the melt kettle and poured into the ordnance. The explosive composition comprised 54.75 weight percent DNAN, 0.25 weight percent MNA, and 45 weight percent ammonium perchlorate. When tested, the composition exhibited a dent depth of 0.879 cm, a card gap value of 48, and an exotherm of 213° C.

Example 2

In a pressurized, steam-heated melt kettle, dinitroanisole (DNAN) and N-methyl-p-nitroaniline (MNA) were introduced and heated above their melting temperature and stirred until melted and homogeneous. Fifty micron ammonium perchlorate particles were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 59.75 weight percent DNAN, 0.25 weight percent MNA, and 40 weight percent ammonium perchlorate. When tested, the composition exhibited a dent depth of 0.76 cm, a card gap value of 85, and an exotherm of 210° C.

Example 3

In a pressurized, steam-heated melt kettle, dinitroanisole (DNAN) and N-methyl-p-nitroaniline (MNA) were introduced and heated above their melting temperatures and stirred until melted and homogeneous. Equal portions of 20 and 200 micron ammonium perchlorate particles were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 64.75 weight percent DNAN, 0.25 weight percent MNA, and 35 weight percent ammonium perchlorate. When tested, the composition exhibited a dent depth of 0.777 cm, a card gap value of 54, and an exotherm of 205° C.

Example 4

In a pressurized, steam-heated melt kettle, dinitroanisole (DNAN) and N-methyl-p-nitroaniline (MNA) were introduced and heated above their melting temperatures and stirred until melted and homogeneous. Equal portions of 20 micron and 200 micron ammonium perchlorate particles were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 54.75 weight percent DNAN, 0.25 weight percent MNA, and 45 weight percent ammonium perchlorate. When tested, the composition exhibited a dent depth of 0.772 cm, a card gap value of 56, and an exotherm of 216° C.

Example 5

In a pressurized, steam-heated melt kettle, dinitroanisole (DNAN) and N-methyl-p-nitroaniline (MNA) were introduced and heated above their melting temperatures and stirred until melted and homogeneous. Fifty micron ammonium perchlorate particles were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 64.75 weight percent DNAN, 0.25 weight percent MNA, and 35 weight percent ammonium perchlorate. When tested, the composition exhibited a dent depth of 0.79 cm, a card gap value of 64, and an exotherm of 207° C.

Example 6

In a pressurized, steam-heated melt kettle, dinitroanisole (DNAN) and N-methyl-p-nitroaniline (MNA) were introduced and heated above their melting temperatures and stirred until melted and homogeneous. Twenty micron ammonium perchlorate particles were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 64.75 weight percent DNAN, 0.25 weight percent MNA, and 35 weight percent ammonium perchlorate. When tested, the composition exhibited a dent depth of 0.851 cm, a card gap value of 78, and an exotherm of 242° C.

Example 7

In a pressurized, steam-heated melt kettle, 4-nitroacetophenone and N-methyl-p-nitroaniline (MNA) were introduced and heated above their melting temperatures and stirred until melted and homogeneous. Four hundred micron ammonium perchlorate particles and 2 micron RDX particles were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 31.75 weight percent DNAN, 0.25 weight percent MNA, 20 weight percent ammonium perchlorate, and 38 weight percent RDX. When tested, the composition exhibited a dent depth of 0.81 cm, a card gap value of 145, and an exotherm of 165° C.

Example 8

In a pressurized, steam-heated melt kettle, dinitroanisole (DNAN) and N-methyl-p-nitroaniline (MNA) were introduced and heated above their melting temperatures and stirred until melted and homogeneous. Equal portions of 20 micron and 200 micron ammonium perchlorate particles were metered into the kettle while maintaining constant stirring. Also added were 2 micron particles of RDX. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 54.75 weight percent DNAN, 0.25 weight percent MNA, 25 weight percent ammonium perchlorate, and 20 weight percent RDX. When tested, the composition exhibited a dent depth of 0.885 cm, a card gap value of 141, and an exotherm of 159° C.

Example 9

In a pressurized, steam-heated melt kettle, dinitroanisole (DNAN) and N-methyl-p-nitroaniline (MNA) were introduced and heated above their melting temperatures and stirred until melted and homogeneous. Twenty micron ammonium perchlorate particles and 2 micron particles of RDX were metered into the kettle while maintaining constant stirring. The explosive composition was then melt poured onto a flaker, cooled at room temperature and broken into small flake-like solid pieces, nominally 0.64 cm (0.25 inch) thick by 1.27×1.27 cm (0.5×0.5 inch). The explosive composition comprised 54.75 weight percent DNAN, 0.25 weight percent MNA, and 25 weight percent ammonium perchlorate, and 20 weight percent RDX. When tested, the composition exhibited a dent depth of 0.899 cm, a card gap value of 132, and an exotherm of 159° C.

Examples 1–6, which consisted of the binder, processing aid, and inorganic oxidizer exhibited dent depths falling within a range of 0.76 cm to 0.879 cm, which are within 10 percent of the dent depth of a TNT sample. Examples 1–6 also exhibited card gap values of 48 to 85, well below that of TNT. The exotherms for Examples 1–6 ranged from 205° C. to 242° C., which are higher than the 185° C. exotherm of TNT.

Examples 7–9 also included an organic oxidizer, RDX. These examples ranged in dent depth from 0.81 cm to 0.899 cm, card gap values from 132 to 145, and exotherms from 159° C. to 165° C. Thus, the addition of large amounts of organic oxidizer adversely affected the shock and thermal sensitivities of the melt-pourable explosive compositions compared to Examples 1–6 but still produced comparable or improved results compared to TNT.

The foregoing detailed description of the preferred embodiments of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

The invention claimed is:

1. A melt-pourable explosive composition comprising:

30 weight percent to 70 weight percent of at least one organic binder selected from the group consisting of mononitro aromatics and dinitro aromatics, the at least one organic binder collectively exhibiting a total energy of detonation lower than trinitrotoluene and collectively having a total melting point in a range of 80° C. to 115° C.; and 30 weight percent to 70 weight percent of at least one oxidizer, wherein the melt-pourable explosive composition is pourable at a temperature in a range of 80° C. to 115° C., and wherein at least 95 weight percent of the melt-pourable explosive composition comprises a combination of the at least one organic binder and the at least one oxidizer.

2. The melt-pourable explosive composition of claim 1, wherein the at least one organic binder comprises at least one mononitro aromatic compound and at least one dinitro aromatic compound.

3. The melt-pourable explosive composition of claim 1, wherein the mononitro aromatics each comprise one nitrocarbon moiety and wherein the dinitro aromatics each comprise two nitrocarbon moieties.

4. The melt-pourable explosive composition of claim 1, wherein the at least one organic binder comprises at least one member selected from the group consisting of mononitro-substituted and dinitro-substituted phenyl alkyl ethers.

5. The melt-pourable explosive composition of claim 1, wherein the at least one organic binder comprises at least one member selected from the group consisting of 2,4-dinitroanisole, 2,4-dinitrophenetole, and 4-methoxy-2-nitrophenol.

6. The melt-pourable explosive composition of claim 1, wherein the at least one organic binder comprises 2,4-dinitroanisole.

7. The melt-pourable explosive composition of claim 1, wherein the at least one organic binder comprises an N-alkyl-nitroaniline processing aid.

8. The melt-pourable explosive composition of claim 1, wherein the at least one organic binder comprises N-methyl-nitroaniline as a processing aid.

9. The melt-pourable explosive composition of claim 1, wherein the at least one organic binder comprises at least one processing aid selected from the group consisting of N-alkyl nitroaniline and N-aryl-nitroaniline, the at least one processing aid accounting for not more than 1 weight percent of the melt-pourable explosive composition.

10. The melt-pourable explosive composition of claim 1, wherein the melt-pourable explosive composition undergoes an onset of thermal decomposition at a temperature that is at least 55.5° C. higher than the temperature at which the melt-pourable explosive composition becomes pourable.

11. The melt-pourable explosive composition of claim 1, wherein the melt-pourable explosive composition exhibits a card gap value of less than 121.

12. The melt-pourable explosive composition of claim 1, wherein the melt-pourable explosive composition exhibits a card gap value of less than 101.

13. The melt-pourable explosive composition of claim 1, wherein the melt-pourable explosive composition exhibits a dent depth in a range of 0.754 cm to 0.922 cm.

14. The melt-pourable explosive composition of claim 1, wherein the melt-pourable explosive composition has a total energy of detonation of 7.1 kJ/cc to 8.7 kJ/cc.

15. A melt-pourable explosive composition comprising:

30 weight percent to 70 weight percent of at least one organic binder selected from the group consisting of mononitro aromatics and dinitro aromatics, the at least one organic binder collectively exhibiting a total energy detonation lower than trinitrotoluene and collectively having a total melting point in a range of 80° C. to 115° C.; and 30 weight percent to 70 weight percent of at least one inorganic oxidizer, wherein the melt-pourable explosive composition is pourable at a temperature in a range of 80° C. to 115° C., and wherein at least 95 weight percent of the melt-pourable explosive composition comprises a combination of the at least one organic binder and the at least one inorganic oxidizer.

16. The melt-pourable explosive composition of claim 15, wherein the at least one organic binder comprises at least one mononitro aromatic compound and at least one dinitro aromatic compound.

17. The melt-pourable explosive composition of claim 15, wherein the mononitro aromatics each comprise one nitrocarbon moiety and wherein the dinitro aromatics each comprise two nitrocarbon moieties.

18. The melt-pourable explosive composition of claim 15, wherein the at least one organic binder comprises at least one member selected from the group consisting of nitrotoluenes, dinitrotoluenes, and dinitronaphthalenes.

19. The melt-pourable explosive composition of claim 15, wherein the at least one organic binder comprises at least one member selected from the group consisting of nitrophenols, dinitrophenols, mononitroanilines, and dinitroanilines.

20. The melt-pourable explosive composition of claim 15, wherein the at least one organic binder comprises at least one member selected from the group consisting of mononitro-substituted and dinitro-substituted phenyl alkyl ethers.

21. The melt-pourable explosive composition of claim 15, wherein the at least one organic binder comprises at least one member selected from the group consisting of 2,4-dinitroanisole, 2,4-dinitrophenetole, and 4-methoxy-2-nitrophenol.

22. The melt-pourable explosive composition of claim 15, wherein the at least one organic binder comprises 2,4-dinitroanisole.

23. The melt-pourable explosive composition of claim 15, wherein the at least one organic binder comprises at least one heterocyclic compound.

24. The melt-pourable explosive composition of claim 15, wherein the at least one organic binder comprises an N-alkyl-nitroaniline processing aid.

25. The melt-pourable explosive composition of claim 15, wherein the at least one organic binder comprises N-methyl-nitroaniline as a processing aid.

26. The melt-pourable explosive composition of claim 15, wherein the at least one organic binder comprises an N-aryl-nitroaniline processing aid.

27. The melt-pourable explosive composition of claim 15, wherein the at least one organic binder comprises at least one processing aid selected from the group consisting of N-alkyl nitroaniline and N-aryl-nitroaniline, the at least one processing aid accounting for not more than 1 weight percent of the melt-pourable explosive composition.

28. The melt-pourable explosive composition of claim 15, wherein the at least one inorganic oxidizer comprises at least one member selected from the group consisting of perchlorates and nitrates.

29. The melt-pourable explosive composition of claim 15, wherein the at least one inorganic oxidizer comprises at least one perchlorate selected from the group consisting of ammonium perchlorate, sodium perchlorate, and potassium perchlorate.

30. The melt-pourable explosive composition of claim 15, wherein the at least one inorganic oxidizer comprises at least one nitrate selected from the group consisting of ammonium nitrate, sodium nitrate, strontium nitrate, and potassium nitrate.

31. The melt-pourable explosive composition of claim 15, wherein the at least one inorganic oxidizer has an average particle size of 3 microns to 60 microns.

32. The melt-pourable explosive composition of claim 15, wherein the at least one inorganic oxidizer has an average particle size of 5 microns to 20 microns.

33. The melt-pourable explosive composition of claim 15, wherein at least 99 weight percent of the melt-pourable explosive composition comprises a combination of the at least one organic binder and the at least one inorganic oxidizer.

34. The melt-pourable explosive composition of claim 15, wherein the melt-pourable explosive composition undergoes an onset of thermal decomposition at a temperature that is at least 55.5° C. higher than the temperature at which the melt-pourable explosive composition becomes pourable.

35. The melt-pourable explosive composition of claim 15, wherein the melt-pourable explosive composition exhibits a card gap value of less than 121.

36. The melt-pourable explosive composition of claim 15, wherein the melt-pourable explosive composition exhibits a card gap value of less than 101.

37. The melt-pourable explosive composition of claim 15, wherein the melt-pourable explosive composition exhibits a dent depth in a range of 0.754 cm to 0.922 cm.

38. The melt-pourable explosive composition of claim 15, wherein the melt-pourable explosive composition has a total energy of detonation of 7.1 kJ/cc to 8.7 kJ/cc.

39. A melt-pourable explosive composition comprising:

30 weight percent to 70 weight percent of at least one organic binder selected from the group consisting of mononitro aromatics and dinitro aromatics, the at least one organic binder collectively exhibiting a total energy detonation lower than trinitrotoluene and collectively having a total melting point in a range of 80° C. to 115° C.; and 30 weight percent to 70 weight percent of at least one inorganic oxidizer, wherein the melt-pourable explosive composition is melt-pourable at a temperature in a range of 80° C. to 115° C., undergoes an onset of thermal decomposition at a temperature that is at least 55.5° C. higher than the temperature at which the melt-pourable explosive composition becomes pourable and exhibits a card gap value of less than 121, a dent depth in a range of 0.754 cm to 0.922 cm, and a total energy of detonation of 7.1 kJ/cc to 8.7 kJ/cc, and wherein at least 95 weight percent of the melt-pourable explosive composition comprises a combination of the at least one organic binder and the at least one inorganic oxidizer.

40. The melt-pourable explosive composition of claim 39, wherein the card gap value exhibited by the melt-pourable explosive composition is less than 101.

41. The melt-pourable explosive composition of claim 39, wherein the card gap value exhibited by the melt-pourable explosive composition is less than 81.

42. The melt-pourable explosive composition of claim 1, wherein at least 99 weight percent of the melt-pourable explosive composition comprises a combination of the at least one organic binder and the at least one inorganic oxidizer.

43. The melt-pourable explosive composition of claim 40, wherein at least 99 weight percent of the melt-pourable explosive composition comprises a combination of the at least one organic binder and the at least one inorganic oxidizer.

* * * * *